US007712189B2

(12) United States Patent
Francisco et al.

(10) Patent No.: US 7,712,189 B2
(45) Date of Patent: May 11, 2010

(54) HIGH TORQUE SMALL HANDLING POLE

(75) Inventors: Gregory A. Francisco, Fremont, CA (US); Robert W. Whitling, Morgan Hill, CA (US)

(73) Assignee: General Electric Company, Schenectady, NY (US)

( * ) Notice: Subject to any disclaimer, the term of this patent is extended or adjusted under 35 U.S.C. 154(b) by 712 days.

(21) Appl. No.: 11/150,193

(22) Filed: Jun. 13, 2005

(65) Prior Publication Data

US 2006/0288537 A1 Dec. 28, 2006

(51) Int. Cl.
*B25G 1/04* (2006.01)

(52) U.S. Cl. ..... 16/429; 16/427

(58) Field of Classification Search ..... 16/429, 16/DIG. 25, DIG. 41, DIG. 24, 422, 427; 81/177.2, 492
See application file for complete search history.

(56) References Cited

U.S. PATENT DOCUMENTS

| | | | | | |
|---|---|---|---|---|---|
| 303,474 | A * | 8/1884 | Webb | 403/349 |
| 1,505,318 | A * | 8/1924 | Berlow | 403/205 |
| 2,841,425 | A * | 7/1958 | Oeters | 403/104 |
| 3,423,781 | A * | 1/1969 | Henson | 15/145 |
| 4,154,545 | A * | 5/1979 | Pinto et al. | 403/104 |
| 4,524,484 | A * | 6/1985 | Graham | 16/429 |
| 4,554,705 | A * | 11/1985 | Murray | 16/110.1 |
| 5,513,622 | A * | 5/1996 | Musacchia, Sr. | 124/89 |
| 5,540,472 | A * | 7/1996 | Dunlap | 294/57 |
| 5,623,525 | A | 4/1997 | Jensen | |
| 5,690,005 | A | 11/1997 | Jung et al. | |
| 5,823,578 | A * | 10/1998 | Chiou | 285/38 |
| 5,878,099 | A | 3/1999 | Burrows et al. | |
| 6,622,941 | B2 | 9/2003 | Ganoza et al. | |
| 6,854,919 | B2 * | 2/2005 | Neumann et al. | 403/326 |
| 6,874,201 | B2 * | 4/2005 | Ta et al. | 16/429 |
| 6,889,405 | B2 * | 5/2005 | Ritrovato et al. | 16/430 |
| 6,925,686 | B2 * | 8/2005 | Heathcock et al. | 16/429 |
| 7,086,115 | B1 * | 8/2006 | Rex et al. | 15/144.1 |
| 2003/0233718 | A1 * | 12/2003 | Heathcock et al. | 15/144.4 |

* cited by examiner

*Primary Examiner*—Victor Batson
*Assistant Examiner*—Jeffrey O'Brien
(74) *Attorney, Agent, or Firm*—Harness, Dickey & Pierce, P.L.C.

(57) ABSTRACT

An apparatus and method for manufacturing a handling pole including a pole section, a pole adapter connected to one end of the pole section, and a spade member connected to the other end of the pole section. The pole adapter may include an upper sleeve and the spade member may include a lower sleeve.

14 Claims, 3 Drawing Sheets

HIGH TORQUE SMALL HANDLING POLE

BACKGROUND OF INVENTION

1. Field of the Invention

This invention relates generally to a tool for handling high torque in a nuclear reactor pressure vessel.

2. Description of Related Art

Repairs and inspections performed within a reactor pressure vessel (RPV) such as a boiling water reactor (BWR) are generally performed with ropes and poles for manual manipulation of tools and/or delivery of dedicated automated tools. The RPV is generally a cylindrical shaped vessel and is closed at both ends (e.g., a bottom head and a removable top head). During a reactor shut down, the top head of the RPV is removed so as to inspect or repair a selected component within. Other components in the RPV located between a top guide and a core plate or below the core plate may also be removed. To perform the inspections and/or repairs, an operator stands on a bridge positioned over the RPV and lowers the tool using ropes and poles, which may extend about eighty (80) feet below. The ability to perform such inspections and/or repairs depends on the dexterity of the operator.

Due to the difficulty in accessing certain locations within the RPV, performing the repairs and/or inspections at such locations can be time consuming and burdensome. It is desirable to limit the time required to perform the repairs and/or inspections in a RPV, due to the enormous daily cost of the reactor being shut down (up to almost a million dollars a day in lost revenue). Reducing the amount of time required to perform such inspections and/or repairs also would facilitate reducing radiation exposure to operators, technicians and maintenance personnel, for example.

An approach to repairing and/or inspecting equipments in the RPV has been to use handling poles to attach tools for repairing and servicing. The handling poles are light-weight and thus easy to maneuver within the RPV. Further, handling poles may be designed specifically to handle high-torque. The handling poles may be generally constructed in 10-foot sections and assembled to work in depths of over 80 feet.

However, conventional handling poles typically fail at connection joints at approximately 50 ft lbs of torque. Hence, a way to produce higher torque has been to use heavier poles in excess of 130 lbs to deliver the torque. But heavier poles require the use of a overhead crane to assemble the poles and lift the assembled pole to its location. In addition, it may be desirable to keep the weight of the poles as low as possible in order to allow extended use by an operator. Thus, heavier poles are less desirable than the smaller, lighter handling poles.

Another approach to generate the high-torque for handling poles has been to use a torque multiplier. However, a torque multiplier is generally larger in size than the smaller handling pole and requires additional readings and calibrations.

SUMMARY OF THE INVENTION

Exemplary embodiments of the present invention are directed to a handling pole for use in a nuclear reactor. The handling pole may include a pole section, a pole adapter connected to one end of the pole section, and a spade member connected to the other end of the pole section. The pole adapter may include an upper sleeve, and the spade member may include a lower sleeve.

Another exemplary embodiment of the present invention is directed to a method for manufacturing a handling pole. The method may include providing a pole section, attaching an adapter pole to one end of the pole section, attaching a spade member to the other end of the pole section, surrounding the adapter pole with an upper sleeve, and surrounding the spade member with a lower sleeve.

BRIEF DESCRIPTION OF THE DRAWINGS

Exemplary embodiments of the present invention will become more apparent by describing, in detail, exemplary embodiments thereof with reference to the attached drawings, wherein like procedures are represented by like reference numerals, which are given by way of illustration only and thus do not limit the present invention.

DETAILED DESCRIPTION OF EXEMPLARY EMBODIMENTS

It should be noted that these Figures are intended to illustrate the general characteristics of method and apparatus of exemplary embodiments of this invention, for the purpose of the description of such exemplary embodiments herein. These drawings are not, however, to scale and may not precisely reflect the characteristics of any given embodiment, and should not be interpreted as defining or limiting the range of values or properties of exemplary embodiments within the scope of this invention. The relative dimensions and size of High Torque Small Handling Pole may be reduced or exaggerated for clarity. Like numerals are used for liked and corresponding parts of the various drawings.

Exemplary embodiments of the present invention may provide an apparatus tool for handling and delivering high-torque. The tool can deliver over 100 ft lbs of torque. The tool may be lightweight so as to be assembled by hand and easily manipulated by an operator. The tool may be manipulated without the need of a overhead crane or hoist. The tool may be the same size as an existing tool, and thus interchangeable with existing tool. The tool may be used as a replacement for heavy-weight high torque tool.

Figure 1A:
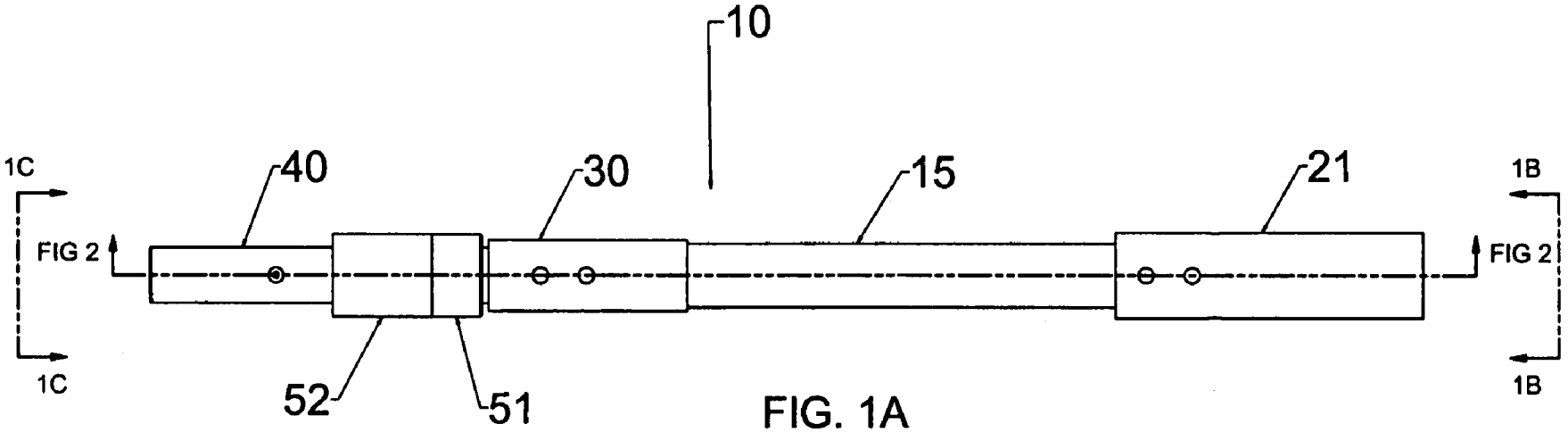
FIG. 1A is a side view of a handling pole in accordance with an exemplary embodiment of the present invention.
Figure 1B:
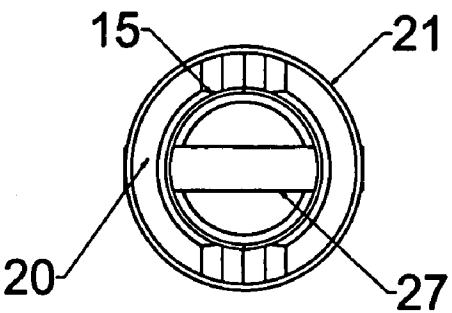
FIG. 1B is a cross-section B-B of the handling pole of FIG. 1A in accordance with an exemplary embodiment of the present invention.
Figure 1C:
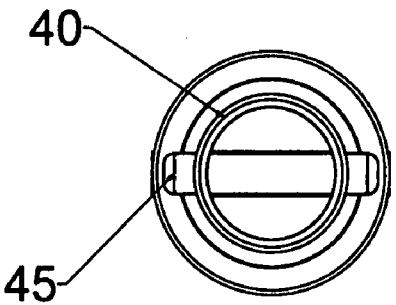
FIG. 1C is a cross-section C-C of the handling pole of FIG. 1A in accordance with an exemplary embodiment of the present invention.

FIG. 1A a side view of a handling pole in accordance with an exemplary embodiment of the present invention. FIG. 1B is a cross-section B-B of the handling pole of FIG. 1A in accordance with an exemplary embodiment of the present invention. FIG. 1C is a cross-section C-C of the handling pole of FIG. 1A in accordance with an exemplary embodiment of the present invention.

Referring to FIG. 1A, the handling pole 10 includes a pole section 15, a pole adapter 20 connected at one end and a spade member 40 connected at the other end. As an example, the pole adapter 20 and the spade member 40 may be welded to the pole section 15. However, it should be appreciated that other attachments may be employed to connect the pole adapter 20 and spade member 40 to the pole section 15. The entire or section of the handling pole 10 may be composed of a light-weight metal, such as, but not limited to, aluminum.

The handling pole 10 is adaptable to produce torque over 100 ft-lb. Each section of the handling pole 10 may be 10 feet in length, and designed to work up to 100 feet depth in the reactor. However, it should be appreciated that each handling pole 10 may be designed as 3 feet, 5 feet or other lengths, depending on the application of the pole. The handling pole 10 may also be the same size as an existing pole, and thus interchangeable with the existing pole (e.g., used for general purpose or non-high torque applications). As a result, the handling pole 10 may reduce the overall job time and may save the cost of developing, building and shipping alternate tooling, such as jet pump breaker poles.

It should be appreciated that the handling pole 10 may also be used as a replacement for heavy-weight high torque poles used, for example, in jet pump beam tensioning. The heavy-weight high torque pole is described in co-pending U.S. application entitled "Apparatus and Method for Measuring Rotation During Jet Pump Tensioning", assigned to General Electric Co., which is hereby incorporated by reference in its entirety.

Figure 2:
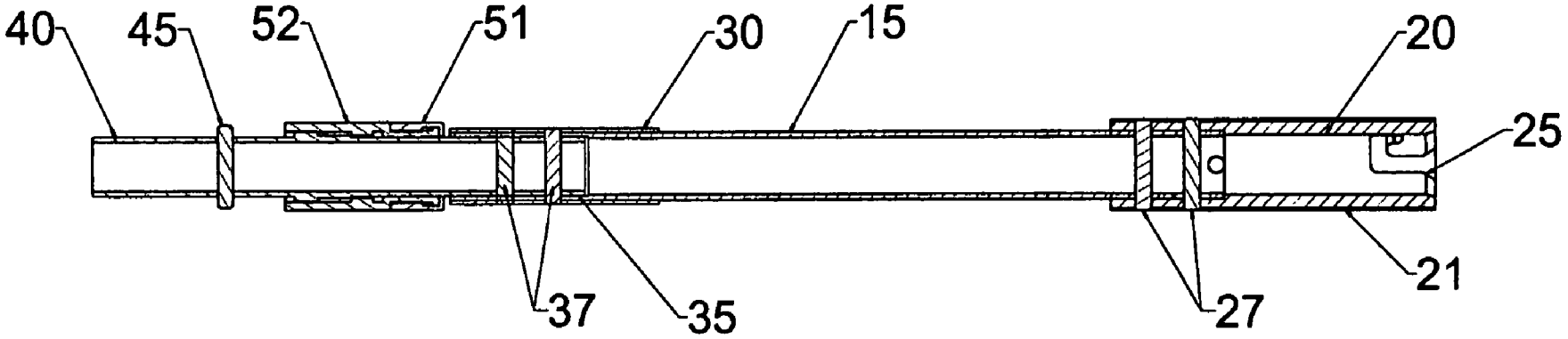
FIG. 2 is a cross-section A-A of the handling pole of FIG. 1A in accordance with an exemplary embodiment of the present invention.

FIG. 2 is a cross-section A-A of the handling pole of FIG. 1A in accordance with an exemplary embodiment of the present invention. The pole adapter 20 has a pair of J-shaped slots 25 (only one of which is shown in FIG. 2) which may receive and interlock with a corresponding pin 45 on spade member 40 (adjacent handling pole). The J-shaped slots 25 provide a slot for pin 45 to slide into so as to provide an engagement between adjacent handling poles 10. The J-shaped slots 25 may be machined into the pole adapter 20. The pole adapter 20 may be made of, for example, aluminum or any other light-weight metal.

An upper sleeve 21 may surround the pole adapter 20 as shown in FIG. 2 for reinforcement. The upper sleeve 21 may be made from stainless steel so as to prevent the J-shaped slots 25 from spreading (deforming) when torque greater than, for example, 50 ft lbs is applied. It should be appreciated that the upper sleeve 21 may be made from other materials, such as steel, aluminum, engineered plastic materials and/or any combination thereof.

The pole adapter 20 includes a pair of dowel pins 27 welded to the upper sleeve at both sides (shown in FIG. 1B) to provide attachment to the pole section 15 and to transmit the torque. In other words, the dowel pins 27 penetrate the upper sleeve 21, the adapter pole 20 and the pole section 15, and penetrate through the other side (e.g., the pole section 15, the adapter pole 20 and the upper sleeve 21). The dowel pins 27 may be welded to the upper sleeve 21 on both sides to transmit the torque from the J-slot 25 to the pole section 15. The pins 27 may be made from, for example, but not limited to, stainless steel. The pins 27 may be ¼ inch in diameter. It should be appreciated that other diameter sizes may be employed.

Figure 3:
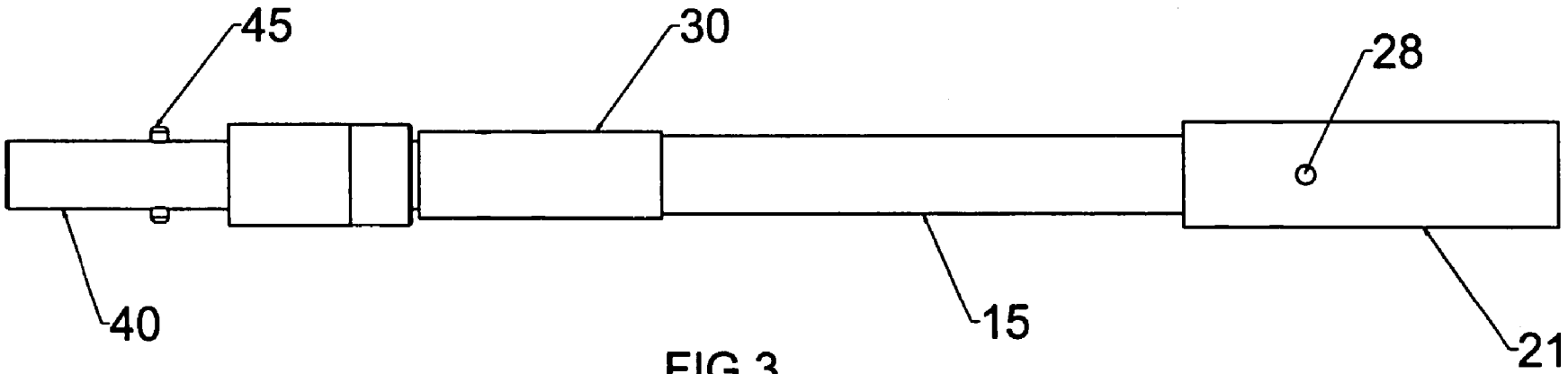
FIG. 3 is a side view of the handling pole rotated in accordance with an exemplary embodiment of the present invention.

FIG. 3 is a side view of the handling pole rotated in accordance with an exemplary embodiment of the present invention. As shown in FIG. 3, the upper sleeve 21 and pole adapter 20 includes a drain hole 28. The drain hole 28 is provided to flush out any fluid trapped in the pole adapter 20. The drain hole 28 may have a diameter of ¼ inch. It should be appreciated that there may be more than one drain hole 28 in the adapter 20. It should further be understood by one of ordinary skilled in the art that the size of the drain hole 28 and pins 27 may vary according to the application of the handling pole.

Referring again to FIG. 2, the pole section 15 is also attached to a spade member 40. The spade member 40 slidably fits within a thinned section 35 of the pole section 15. In other words, the spade member 40 may act as a male connector for engaging with the pole adapter 20. The thinned section 35 of the pole section 15 may be embodied as having a larger bore diameter than the bore diameter of the adapter pole 20. As an example, the pole section 15 attached to the spade member 40 may have a bore diameter of approximately 0.905 inches and the pole section 15 attached to the adapter pole 20 may have a bore diameter of approximately 0.860 inches. The spade member 40 may be made from, for example, but not limited to, Stainless steel.

The spade member 40 includes a spade pin 45 to slidably engage into the J-shaped slots 25. The spade pin 45 has a dimension to engage with the J-shaped slots 25 and withstand the produced torque without failure. The spade member 40 may be bored with a hole approximately 6 mm through and machined on both sides of the spade member 40 so that the spade pin 45 can be inserted. The spade pin 45 is welded to the spade member 40 at both sides in the machined slot (shown in FIG. 1C) so as to prevent buckling. In other words, the spade member 40 is machined with holes and shallow slots on both side of the spade member 40 for spade pin 45 to be inserted and welded within the slot. The spade pin 45 is then centered in the spade member 40 and welded at least in four areas (e.g., on both sides of the spade pin 45 and on both sides of the spade member 40). The spade pin 45 may extend approximately 0.178 inches out from the surface of the space member 40. The spade pin 45 may be made from, for example, but not limited to, stainless steel. It should be appreciated by one skilled in the art that the dimensions of the spade pin 45 may be employed with different sizes.

The spade member 40 is attached to the pole section 15 via a pair of lower pins 37. The lower pins 37 may be similar and may function the same as the dowel pins 27 found in the pole adapter 20. The area engaging the spade member 40 and the pole section 15 is surrounded with a lower sleeve 30 for reinforcing the connection. The lower sleeve 30 is also attached to the spade member 40 through the pair of lower pins 37. The pins 37 are welded to the sleeve 30 at both sides to provide attachment to the pole section and to transmit the high torque. In other words, the lower pins 37 may penetrate the lower sleeve 30, the pole section 15 and then the spade member 40, and penetrate out the other side (e.g., the spade member 40, the pole section 15 and then the lower sleeve 30). The lower pins 37 are welded to the lower sleeve 30 on both sides to prevent buckling of the thinned area of the section pole 15 and transmit torque through the spade pins 45.

The lower sleeve 30 may be made of, for example, but not limited to, stainless steel, aluminum, steel, engineered plastic materials and/or any combination thereof. In an example, the lower sleeve 30 may be made from the same material as the upper sleeve 21 for ease in manufacturing. The pins 37 may be made from, for example, but not limited to, stainless steel. The lower pins 37 may be ¼ inch in diameter. It should be appreciated that other diameter sizes may be employed.

Referring again to FIG. 1A, the handling pole 10 includes an upper nut 51 and a bottom nut 52. The upper nut 51 and bottom nut 52 are threaded around the spade member 40. As a result, the upper nut 51 and bottom nut 52 are used to connect and lock together adjacent handling poles 10. The bottom nut 52 threads on the handling pole 10 and the upper nut 51 threads on to the bottom nut 52. The upper and bottom nut is described in detail in co-pending U.S. application entitled "Nut Assembly for Handling Poles and Method Thereof", assigned to General Electric Co., which is hereby incorporated by reference in its entirety.

Exemplary embodiment of the present invention provides the pole adapter having a J-shaped slot which receive and interlock with a corresponding pin on an adjacent handling pole. The J-shaped slot prevents and/or reduces the pole adapter from dis-engaging with the spade member.

Exemplary embodiment of the present invention provides a pair of upper pins welded to the upper sleeve at both sides to prevent the pole section from buckling around the upper pins.

Exemplary embodiment of the present invention provides a pair of lower pins welded to the lower sleeve at both sides to prevent the pole section from buckling around the lower pins.

Exemplary embodiment of the present invention provides the spade member having a spade pin to slidably engage into J-shaped slots. The spade pin welded to the spade member at both sides of the spade member prevents buckling.

Exemplary embodiment of the present invention provides machining at least one hole in both sides of the upper sleeve, adapter pole and the pole section, inserting at least one upper pin into the hole, and welding at least one upper pin on the upper sleeve.

Exemplary embodiments of the present invention may provide an apparatus tool for handling high-torque over 100 ft lbs. The handling tool may be lightweight so as to be assembled by hand and easily manipulated by the operator without the need of a overhead crane or hoist.

The exemplary embodiments of the present invention being thus described, it will be obvious that the same may be varied in many ways. Such variations are not to be regarded as departure from the spirit and scope of the exemplary embodiments of the present invention, and all such modifications as would be obvious to one skilled in the art are intended to be included within the scope of the following claims.

What is claimed:

1. A handling pole configured to engage in-vessel tooling for use in a nuclear reactor, comprising:

a pole section with a first end and a second end;

a pole adapter with a first end and a second end, the first end of the pole adapter connected to the first end of the pole section, the pole adapter having a diameter greater than the diameter of the pole section allowing the first end of the pole adapter to act as a female connector for the first end of the pole section which acts as a male pole section;

a spade member with a first end connected to the second end of the pole section;

a lower sleeve covering at least a portion of the first end of the spade member and at least a portion of the second end of the pole section;

a J-shaped slot on the second end of the pole adapter which receives and interlocks with a corresponding pin on a second end of the spade member of an adjacent handling pole;

an upper sleeve surrounding the pole adapter and the J-shaped slot, the upper sleeve rigidly connected to the pole adapter and the first end of the pole section, wherein the upper sleeve reinforces the pole adapter and prevents the J-shaped slot from deforming when torque of greater than 50 ft-lbs is applied to the adjacent handling pole about a longitudinal axis; and an upper pin in the pole adapter, the upper pin penetrating the upper sleeve, the first end of the pole adapter, and the first end of the pole section.

2. The handling pole of claim 1, wherein the upper sleeve and the lower sleeves are stainless steel.

3. The handling pole of claim 1, wherein the pole adapter is an aluminum material.

4. The handling pole of claim 1, wherein the spade member is stainless steel material.

5. The handling pole of claim 1, further comprising a second upper pin in the pole adapter, the second upper pin penetrating the upper sleeve, the first end of the pole adapter, and the first end of the pole section.

6. The handling pole of claim 5, wherein the upper pins are welded to the upper sleeve at both sides to prevent the pole section from buckling around the upper pins.

7. The handling pole of claim 6, wherein the upper pins are stainless steel.

8. The handling pole of claim 1, further comprising a pair of stainless steel lower pins in the spade member and the pole section.

9. The handling pole of claim 8, wherein the pair of lower pins are welded to the lower sleeve at both sides to prevent the pole section from buckling around the lower pins.

10. The handling pole of claim 1, wherein the pole adapter includes a drain hole for flushing out any fluid trapped in the pole adapter.

11. The handling pole of claim 1, wherein the spade member is bored to receive a spade pin to slidably engage into the J-shaped slot.

12. The handling pole of claim 11, wherein the spade pin is welded to the spade member at both sides of the spade member to prevent buckling.

13. The handling pole of claim 11, wherein the spade pin is made of 6 mm diameter stainless steel.

14. The handling pole of claim 1, further comprising an upper nut and a bottom nut.

* * * * *